United States Patent [19]

Yanagawa et al.

[11] 4,372,547

[45] Feb. 8, 1983

[54] SHEET FEED APPARATUS

[75] Inventors: Nobuyuki Yanagawa; Kenichi Mizuma, both of Tokyo, Japan

[73] Assignee: Ricoh Company, Ltd., Tokyo, Japan

[21] Appl. No.: 264,761

[22] Filed: May 18, 1981

Related U.S. Application Data

[63] Continuation of Ser. No. 88,986, Oct. 29, 1979, abandoned.

[30] Foreign Application Priority Data

Dec. 29, 1978 [JP] Japan ..... 53-165265
Dec. 29, 1978 [JP] Japan ..... 53-165266

[51] Int. Cl.[3] ..... B65H 3/06; B65H 3/56

[52] U.S. Cl. ..... 271/10; 271/127; 271/160; 271/164; 271/170

[58] Field of Search ..... 271/127, 117, 118, 121, 271/126, 114, 116, 109, 37, 170, 171, 164, 162, 160, 123, 10, 242, 243, 245, 246

[56] References Cited

U.S. PATENT DOCUMENTS

| | | | |
|---|---|---|---|
| 1,918,460 | 7/1933 | Eccardt | 271/127 UX |
| 3,184,231 | 5/1965 | Varrichio | 271/117 |
| 3,599,971 | 8/1971 | Moridka | 271/162 X |
| 3,689,064 | 9/1972 | Kuksa | 271/127 X |
| 4,071,295 | 1/1978 | Komori et al. | 271/242 X |

FOREIGN PATENT DOCUMENTS 2223279 11/1973 Fed. Rep. of Germany ..... 271/170

OTHER PUBLICATIONS

Beentjes, P. et al., "Picker Mechanism", *IBM Technical Disclosure Bulletin,* vol. 16, No. 1, Jun. 1973, p. 63.

*Primary Examiner*—Bruce H. Stoner, Jr.
*Attorney, Agent, or Firm*—David G. Alexander

[57] ABSTRACT

A stack of sheets (59) are placed on a movable bottom plate (53) of a cassette (52) and aligned with a leading edge and a side edge of the cassette (52). A corner separator (66) is provided at the corner of the leading and side edges. The bottom plate (53) is raised so that the top sheet (59) engages with a single feed roller (61) which is disposed adjacent to the corner separator (66). A skew preventing roller (68) engages with the top sheet (59) upstream of the feed roller (61)in a feed direction of the sheet (59). A manual lever (88) is provided to move the skew preventing roller (68) and an arm (56) for raising the bottom plate (53) clear of the cassette (52) for the purpose of detaching or inserting the cassette (52) in a frame (94). In a released position of the lever (88), a portion (122) of the lever (88) blocks insertion and detachment of the cassette (52) while the skew preventing roller (68) and raising arm (56) are in operative positions.

13 Claims, 14 Drawing Figures

SHEET FEED APPARATUS

CROSS REFERENCE TO RELATED APPLICATION

This application is a continuation of copending U.S. patent application Ser. No. 88,986, filed Oct. 29, 1979, now abandoned.

BACKGROUND OF THE INVENTION

The present invention relates to a sheet feed apparatus for an electrostatic copying machine or the like.

Electrostatic copying machines typically comprise a cassette for holding a stack of copy sheets. Such cassette includes a bottom plate for supporting the stack which is raised so that the top sheet of the stack engages with feed rollers provided above the cassette. A corner separator is provided at the leading edge corners of the stack such that when the feed rollers are rotated the top sheet is fed toward the corner separators. The corner separators cause the leading edge of the copy sheet to flex and pop out of the cassette for feeding to register rollers and a transfer station.

A problem has existed heretofore regarding skew feed of the copy sheet. This occurs when the copy sheets are closer to one side of the cassette than the other or when the copy sheets are not stacked evenly in the cassette. This latter condition also results in a particular copy sheet being closer to one side of the cassette than the other. Under such conditions, the result is that one of the corner separators exerts a greater force on the leading edge of the sheet than the other corner separator so that a rotational moment is imparted to the copy sheet about its center of gravity. The rotation of the copy sheet results in skew feed such that the side edges of the copy sheet are not parallel to the feed direction. Assuming that the skewed copy sheet does not jam in the feed path of the copying machine, which often happens, the copy image will appear tilted on the copy sheet.

In the prior art system described above, a feed roller must be provided adjacent to each corner separator, and the rollers must be spaced equally from the side edges of the copy sheets to prevent rotational moments and skew feed. However, it is desirable to be able to produce copies on different sizes of copy sheets, such as ISO sizes A4, B4, B5, etc. This may be done by providing several cassettes of the desired sizes in a vertically stacked arrangement and a separate feed roller set for each cassette. The feed rollers are individually driven in accordance with the desired copy sheet size. This system, although efficient, is quite expensive due to the several sets of feed rollers and interconnecting mechanism.

It is also possible to provide several copy sheet sizes using a single set of feed rollers. In one case cassettes of different sizes are provided and selectively inserted in the copying machine frame below the feed rollers. In another system a single cassette is provided and the stack of copy sheets is placed in the cassette in alignment with a front edge and a side edge of the cassette. In each case, it is necessary to provide a separate feed roller for the other side edge of the copy sheet corresponding to each sheet size. For example, if the copying machine is designed to utilize A4, B4 and B5 size sheets, there must be at least four feed rollers; one for the aligned side edge and three for the non-aligned side edges. The disadvantage of this arrangement is that a rotational moment is imparted to the sheet for the larger sheet sizes due to the fact that more than one feed roller engages the non-aligned side edge portion of the sheet resulting in skew feed.

A prior art proposal to overcome this problem is to slidably mount a single non-aligned side edge feed roller and position it in accordance with the sheet size. If the roller is positioned automatically, a complicated mechanism is required. If the roller is positioned manually, it will often be moved to the wrong position or neglected by inexperienced or careless operators with the inevitable result of skew feed.

In most conventional copying machines the cassettes are partially inserted from the side and protrude from the side of the copying machine. This prevents the copying machine from being installed in a compact space in an office since additional space must be provided at the side of the copying machine for the cassettes and even more space must be provided to allow the cassettes to be inserted and detached from the machine. The cassettes are inserted from the side in such copying machines since the insertion and detachment direction must be parallel to the feed direction. The wasted space inherent in such a system is undesirable.

SUMMARY OF THE INVENTION

A sheet feed apparatus embodying the present invention includes sheet support means for supporting a stack of sheets, a corner separator disposed at a corner of the support means, a corner of the stack of sheets being aligned with the corner of the support means and a feed roller disposed adjacent to the corner of the support means for feeding a top sheet of the stack of sheets in a direction such that a leading edge of the top sheet is separated from the stack by the corner separator, and is characterized by comprising skew preventing means disposed upstream of the feed roller in the direction of movement of the top sheet for frictionally engaging with and resisting skew of the top sheet.

In accordance with the present invention, a stack of sheets are placed on a movable bottom plate of a cassette and aligned with a leading edge and a side edge of the cassette. A corner separator is provided at the corner of the leading and side edges. The bottom plate is raised so that the top sheet engages with a single feed roller which is disposed adjacent to the corner separator. A skew preventing roller engages with the top sheet upstream of the feed roller in a feed direction of the sheet. A manual lever is provided to move the skew preventing roller and an arm for raising the bottom plate clear of the cassette for the purpose of detaching or inserting the cassette. In a released position of the lever, a portion of the lever blocks insertion and detachment of the cassette while the skew preventing roller and raising arm are in operative positions.

It is an object of the present invention to prevent skew feed in a sheet feed apparatus.

It is another object of the present invention to provide a sheet feed apparatus comprising a single corner separator and a single feed roller and means for preventing skew feed of copy sheets.

It is another object of the present invention to provide a sheet feed apparatus which can accommodate sheets of any size without adjustment.

It is another object of the present invention to provide a sheet feed apparatus comprising a cassette which can be inserted into a frame of the apparatus in a direction perpendicular to a direction of sheet feed and which may additionally be inserted completely into the frame.

It is another object of the present invention to provide a sheet feed apparatus which can accommodate any size of sheets in a single cassette.

It is another object of the present invention to provide a sheet feed apparatus comprising means for automatically preventing damage to parts of a mechanism which engage with a cassette by preventing the cassette from being inserted into or detached from a frame with said parts in their operative positions.

It is another object of the present invention to provide a generally improved sheet feed apparatus for an electrostatic copying machine or the like.

Other objects, together with the foregoing, are attained in the embodiments described in the following description and illustrated in the accompanying drawing.

DESCRIPTION OF THE PREFERRED EMBODIMENTS

While the sheet feed apparatus of the present invention is susceptible of numerous physical embodiments, depending upon the environment and requirements of use, substantial numbers of the herein shown and described embodiments have been made, tested and used, and all have performed in an eminently satisfactory manner.

Figure 1:
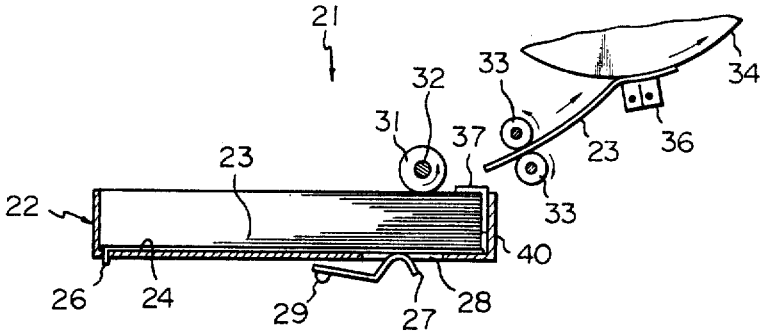
Fig. 1 PRIOR ART
FIG. 1 is a partial schematic diagram illustrating a prior art sheet feed system.

Referring now to FIG. 1 of the drawing, a sheet feed system of the present type is generally designated by the reference numeral 21 and comprises a cassette 22 for supporting or holding a stack of copy sheets 23. The cassette 22 comprises a bottom plate 24 which is movable, or more specifically tiltable, about a pivotal edge 26, and supports the stack of sheets 23. A raising arm 27 fixed to a shaft 29 is rotatable in the counterclockwise direction to enter a hole 28 in the bottom of the cassette 22 and tilt the bottom plate 24 counterclockwise so that the top sheet of the stack 23 is pressed against feed rollers 31.

The feed rollers 31 are fixed to a rotary shaft 32 which is rotatable in the counterclockwise direction to feed the top sheet 23 rightwardly into the bite of register rollers 33. The sheet 23 is fed by the register rollers 33 to a photoconductive drum 34 which is rotated counterclockwise at constant speed and carries a toner image of an original document (not shown). The sheet 23 is fed at the same surface speed as the drum 34. A transfer charger 36 transfers the toner image to the sheet 23 which is fixed thereto to provide a permanent copy.

Figure 2:
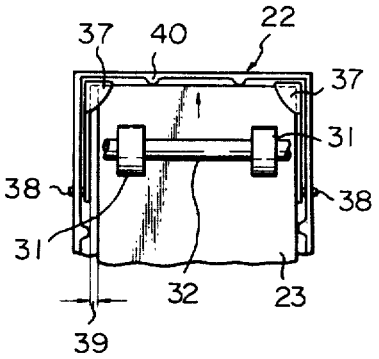
Fig. 2 PRIOR ART
FIG. 2 is a partial plan view illustrating a prior art sheet feed system.
Figure 3:
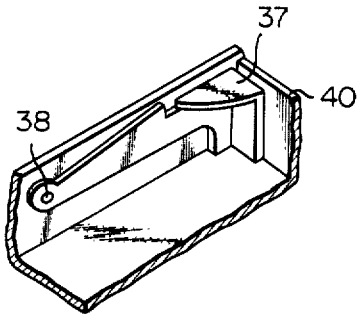
Fig. 3 PRIOR ART
FIG. 3 is an enlarged perspective view of a corner separator.

As shown in FIG. 2, the cassette 22 comprises two corner separators 37 provided at the leading edge corners of the cassette 22. The separators 37 are pivotal about pins 38 and urged by gravity downwardly to press on the upper corners of the stack 23. Feeding of the top sheet 23 by the feed rollers 31 causes the corners of the top sheet 23 to abut against the corner separators 37 and the portion of the leading edge of the sheet 23 therebetween to buckle upwardly. Further feeding of the sheet 23 causes the leading edge to pop upwardly out of the corner separators 37 and above a front wall 40 of the cassette 22 for feeding to the register rollers 33. One of the corner separators 37 is shown to enlarged scale in FIG. 3.

As further illustrated in FIG. 2, it often occurs that the stack 23 is placed in the cassette 22 in such a manner that one of the side edges of the stack 23, in this case the right edge, is closer to the adjacent wall of the cassette 22 than the other side edge. As shown, a space 39 exists between the left edge of the stack 23 and the left wall of the cassette 22. This means that the left corner separator 37 will act on the top sheet 23 to a lesser extent than the right corner separator 37 and the sheet 23 will be imparted with a clockwise moment about its center of gravity. This will result in skewed feed of the sheet 23.

Figure 4:
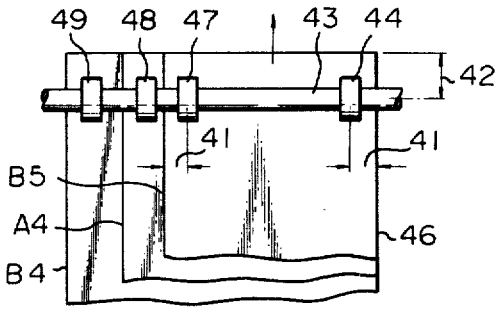
Fig. 4 PRIOR ART
FIG. 4 is a diagram illustrating the drawbacks of the prior art.

FIG. 4 illustrates a prior art expedient for accommodating sheets of different sizes. A shaft 43 is provided above the leading edge portion of a B5, A4 or B4 copy sheet which is aligned with a side edge 46 of the cassette 22. The shaft 43 is spaced by a distance 42 from a leading edge (upper edge) of the sheet. Feed rollers 44, 47, 48 and 49 are fixed to the shaft 43 for feeding the sheet upwardly as viewed in the drawing. The roller 44 is spaced by a distance 41 from the edge 46. In order to prevent skewed feed of the B5 sheet, the roller 47 is spaced by the same distance 41 from the left edge of the B5 sheet. The rollers 49 and 48 are spaced by the distance 41 from the left side edges of the B4 and A4 sheets respectively.

No problem is encountered in feeding the B5 sheet. However, for feeding the A4 sheet, the roller 44 feedingly engages with the right edge portion of the sheet whereas both rollers 47 and 48 engage with the left edge portion of the sheet. The result is a rotational moment in the clockwise direction about the center of gravity of the sheet resulting in skewed feed. The situation is worse for the B4 sheet since all three rollers 47, 48 and 49 act on the left edge portion of the sheet while only the single roller 44 acts on the right edge portion.

This problem may be overcome by providing only the rollers 44 and 47 and mounting the roller 47 in such a manner as to be selectively slidable on the shaft 43 from its illustrated position to the positions of the rollers 48 and 49. However, this requires a complicated mechanism which adds to the manufacturing cost.

Figure 5:
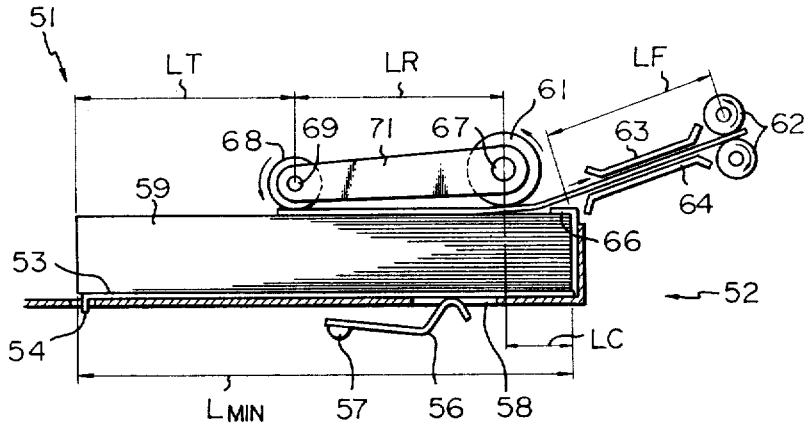
FIG. 5 is a schematic diagram illustrating a sheet feed apparatus embodying the present invention.

FIG. 5 illustrates a sheet feed apparatus embodying the present invention which overcomes the drawbacks of the prior art and is generally designated by the reference numeral 51. The apparatus 51 comprises a cassette 52 having a bottom plate 53 pivotal about an edge 54. A raising arm 56 mounted on a rotary shaft 57 may intrude through a hole 58 in the bottom of the cassette 52 to tiltably raise the bottom plate 53 so that a top sheet of a stack 59 engages with a single feed roller 61. The feed roller 61 feeds the top sheet 59 rightwardly into the bite of register rollers 62 via guides 63 and 64. The cassette 52 is provided with a single corner separator 66 disposed adjacent to the roller 61.

The roller 61 is fixed to a rotary shaft 67 for integral counterclockwise rotation to feed the top sheet 59 rightwardly from the cassette 52 into the bite of the register rollers 62. In accordance with an important feature of the present invention, a skew preventing roller 68 is rotatably mounted via a pin 69 to the end of an arm 71 which is in turn rotatably supported by the shaft 67. The roller 68 is urged downwardly by gravity into pressing engagement with the top sheet 59. It will be noted that the roller 68 is provided parallel to and upstream of the roller 61 in the direction (rightward) of feeding of the sheet as viewed in FIG. 5.

Figure 6:
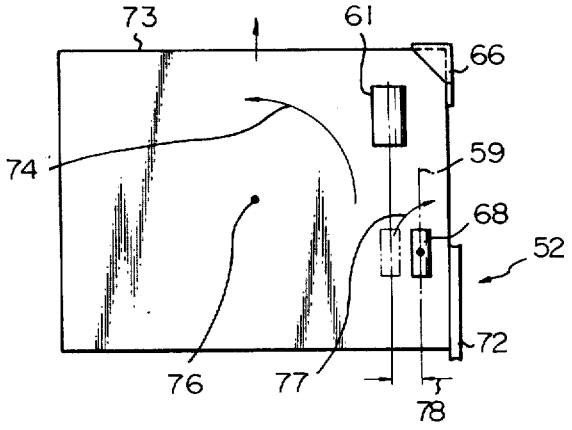
FIG. 6 is a diagram illustrating the operation of the present invention.

Referring now to FIG. 6, it will be seen that the stack of sheets 59 are aligned with a right side wall 72 of the cassette 52 as well as with a leading edge as indicated at 73. The sheet 59 is fed upwardly by the single feed roller 61 as viewed in FIG. 6. It will be noted that the sheets 59 may be of any size since they are aligned with the edges 72 and 73 and thereby the corner thereof of the cassette 52 and fed by only one feed roller 61.

However, since only one feed roller 61 is provided, a counterclockwise moment as indicated at 74 is imparted to the sheet 59 about its center of gravity 76. This moment, without compensation as provided by the present invention, would cause the sheet 59 to rotate or skew counterclockwise. The right edge of the sheet 59 would pop up over the top of the wall 72 and allow the sheet 59 to be fed in a highly skewed manner.

This action is prevented by the roller 68. Although the roller 68 is free to rotate and allow the sheet 59 to be fed straight, it presents a high degree of frictional resistance to movement perpendicular to the direction of sheet feed. This results in a clockwise moment as indicated at 77. The skew preventing moment is increased by displacing the roller 68 rightwardly of the roller 61 by a distance 78 which is selected so that all moments cancel. This allows the sheet 59 to be fed straight by only one feed roller 61. The position of the roller 68 is selected to cancel the moment 74 introduced by the feed roller 61 as well as a moment introduced by resistance of the corner separator 66, a moment introduced by resistance of the side wall 72 and a moment introduced through friction between the top sheet 59 and the lower sheets of the stack. This enables the present apparatus 51 to straightly feed sheets of any size, even postcard size, and also enables transverse feed.

The distance LR between the rollers 61 and 68 is selected to be as large as possible to maximize the skew preventing effect of the roller 68, but is constrained as follows, where Lmin is the minimum length of a sheet 59 which the apparatus 51 is designed to accommodate in the feed direction, LT is the distance between the roller 68 and the trailing edge of the minimum length sheet 59, LC is the distance between the roller 61 and the leading edge of the stack of sheets 59 and LF is the distance between the leading edge of the sheet 59 and the register rollers 62.

In order to ensure skew preventing action, the roller 68 must still engage the sheet 59 when the sheet 59 enters the bite of the register rollers 62. To provide this condition, the following relation must hold $$\mathrm{Lmin} \geqq \mathrm{LR} + \mathrm{LC} + \mathrm{LF} \tag{1}$$

Generally, LC has a specific practical range such as 20–30 mm and is fixed. Due to the overall design requirements of the apparatus 51, the distance LF is also fixed. Thus, the two variables are LR and LT.

From the geometry of the apparatus 51, the following relation holds $$Lmin = LT + LR + LC \tag{2}$$

Combination of inequality (1) and equation (2) produces the following $$\mathrm{LT} \geqq \mathrm{LF} \tag{3}$$

Once LT is determined by means of inequality (3), LR may be determined by rewriting equation (2) as follows $$LR = Lmin - (LT + LC) \tag{4}$$

Although the roller 68 has been described and illustrated as being freely rotatable, it may be connected for rotation together with the feed roller 61 at the same surface speed and direction thereas. It is also well within the scope of the present invention to mount the roller 68 independently of the roller 61 and shaft 67 and/or provide a spring or other biasing means for urging the roller 68 into engagement with the top sheet 59 to assist gravity, although not illustrated.

Figure 7:
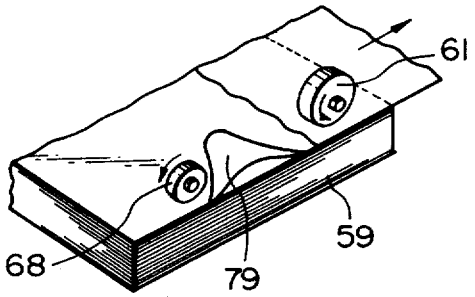
FIG. 7 is a partial perspective view illustrating a problem which may occur in the basic embodiment of the present invention.

FIG. 7 illustrates a problem which may occur with the basic embodiment as shown in FIG. 5. Due to the inertia of the roller 68, it may continue to rotate after the roller 61 stops feeding the sheet 59. This causes the portion of the sheet 59 between the rollers 61 and 68 to buckle upwardly as indicated at 79. This condition, if uncorrected, may cause skew feed of the top sheet 59 due to the resilient restoring force of the buckle 79 and/or cause the sheet 59 below the top sheet to be buckled and fed together with the top sheet 59. This problem is especially acute in cases where the distance between the rollers 61 and 68 is large and the number of sheets in the stack 59 is relatively small.

Figure 8:
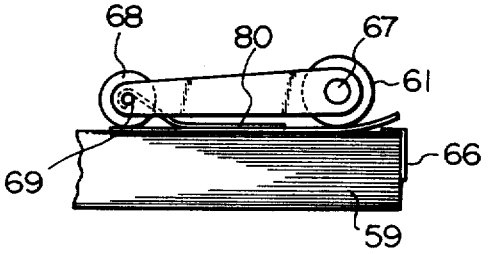
FIG. 8 is a diagram illustrating means for solving the problem illustrated in FIG. 7.

This problem is overcome as illustrated in FIG. 8 by providing a presser plate 80 between the rollers 61 and 68 to press down the sheet 59 and prevent it from buckling. As illustrated, the plate 80 is pivoted to the shaft or pin 69 which supports the roller 68 and urged into pressing engagement with the sheets 59 by gravity. It is of course possible within the scope of the present invention to mount the plate 80 independently of the rollers 61 and 68 and spring load it, although not illustrated.

Figure 9:
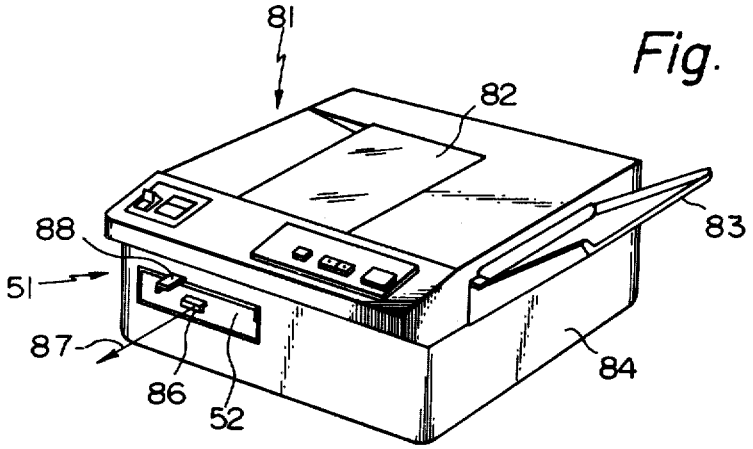
FIG. 9 is a general perspective view of an electrostatic copying machine incorporating the present sheet feed apparatus.

FIG. 9 illustrates the general appearance of an electrostatic copying machine designated as 81 which incorporates the present apparatus 51. The copying machine 81 comprises a glass platen 82 for supporting an original document, a discharge tray 83, and various controls and other elements which are not the subject matter of the present invention and will not be described in detail. The cassette 52 is shown as being inserted into a frame 84 of the copying machine 81 from the front. The cassette 52 is prevented from being detached from the frame 84 by a manually movable lever 88 which will be described in detail below. The cassette 52 may be detached from the frame 84 by moving the lever 88 leftwardly out of the path of the cassette 52 and pulling the cassette 52 out of the frame 84 in the direction of an arrow 87 by means of a handle 86. The direction of the arrow 87 is perpendicular to a direction of sheet feed as will become apparent from further description.

Figure 10:
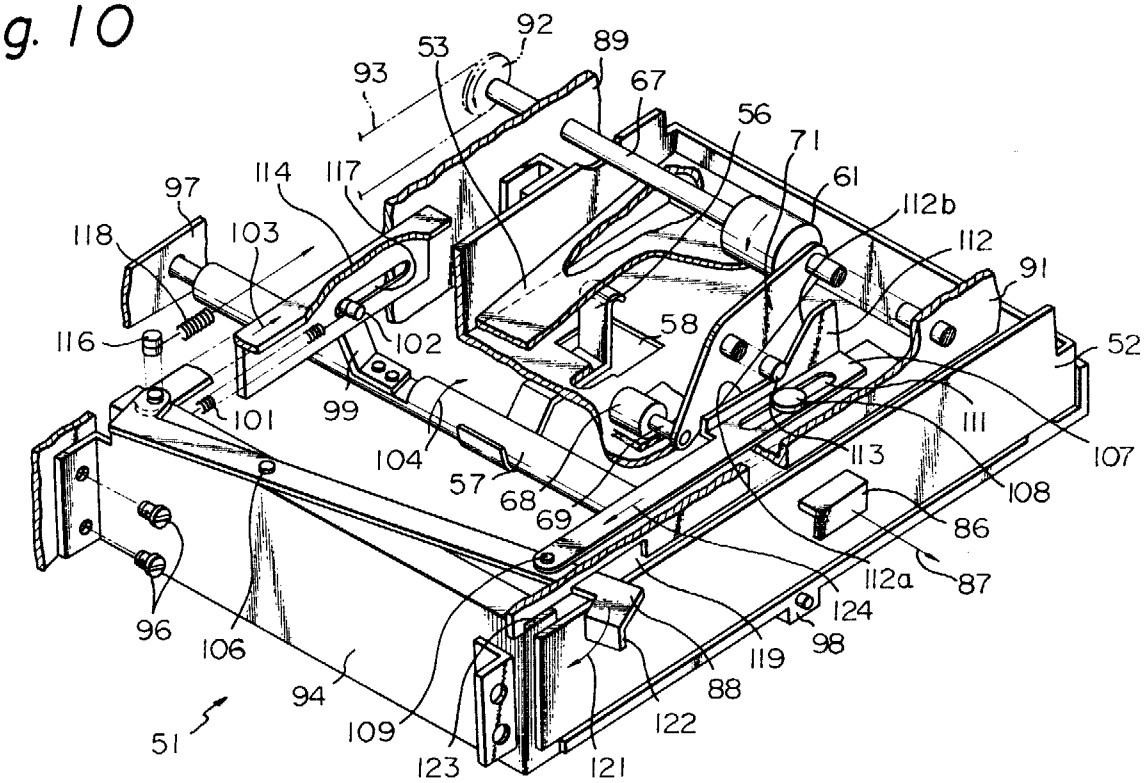
FIG. 10 is a detailed perspective view of the present sheet feed apparatus.

The detailed configuration of the apparatus 51 is shown in FIG. 10. The shaft 67 is rotatably supported by side members 89 and 91 and drivable as indicated by arrows for sheet feed by means of a pulley 92 and belt 93. The cassette 52 is detachably mounted in a box frame 94 which is attached to the main frame 84 by screws 96, with the frame 94 being mounted below the shaft 67. The shaft 57 is rotatably supported by a frame member 97 and a downward extension 98 of the frame 94. An arm 99 is fixed to the shaft 57. A tension spring 101 connected between the frame 94 and a pin 102 fixed to the end of the arm 99 urges the pin 102 to move opposite to the direction of an arrow 103. This causes the shaft 57 to rotate opposite to the direction of an arrow 104 and causes the raising arm 56 to intrude upwardly through the hole 58 and raise the bottom plate 53 and thereby the stack of sheets 59 into engagement with the roller 61. The raising force of the arm 56 is determined by the force of the spring 101.

The lever 88 is pivoted to an upper surface of the frame 94 by a pin 106. A slide bar or link 107 is pivotally connected to the lever 88 by a pin 109 and is slidable on the upper surface of the frame 94. The link 107 is formed with an axial guide slot 111. A pin 108 extends upwardly from the frame 94 and is fitted in the slot 111 for guiding the movement of the link 107.

A cam 112 extends vertically upwardly from the link 107 and is formed integrally therewith. The cam 112 has a cam surface comprising a low portion 112*a* and a high portion 112*b*. A pin 113 extending horizontally from the arm 71 constitutes a cam follower in conjunction with the surface of the cam 112.

Figure 13:
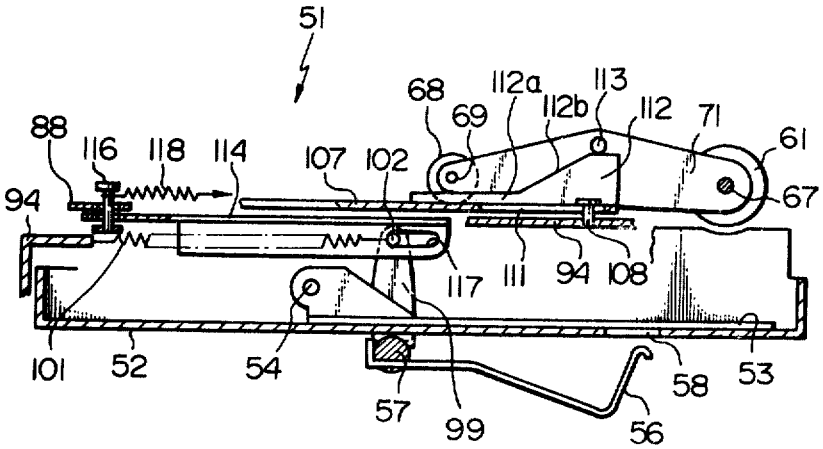
FIG. 13 is similar to FIG. 12 but illustrates a case in which a cassette is to be detached from a frame.
Figure 14:
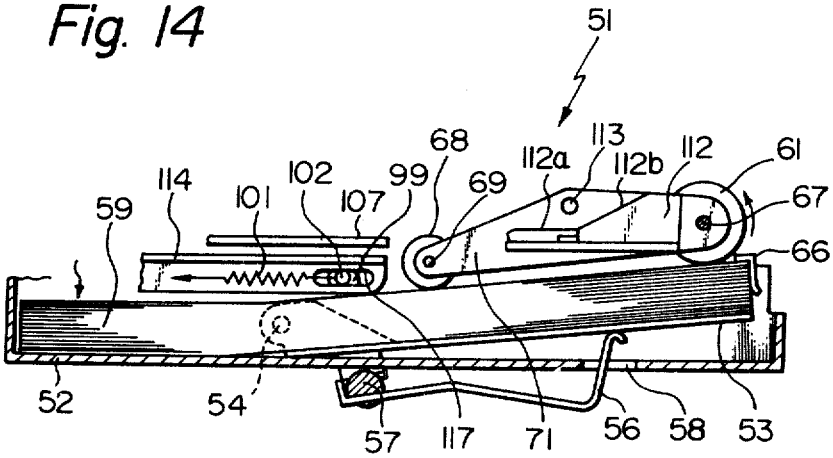
FIG. 14 is also similar to FIG. 12 but illustrates a case in which a cassette holding a new stack of sheets has been inserted into the frame and the mechanism has assumed an operative condition.

The apparatus 51 further comprises a slide link or bar 114 which is pivotally connected to the lever 88 by a pin 116 and, although not illustrated explicitly, is guided by the member 89 for horizontal movement parallel to the arrow 103. The link 114 is formed with an axial slot 117 which receives the pin 102. A tension spring 118 is connected to the pin 116 and urges the link 114 in the direction of the arrow 103. The fulcrum 54 for the bottom plate 53 is shown in FIGS. 12 to 14 as being constituted by pins extending inwardly from the side walls of the cassette 52.

Figure 12:
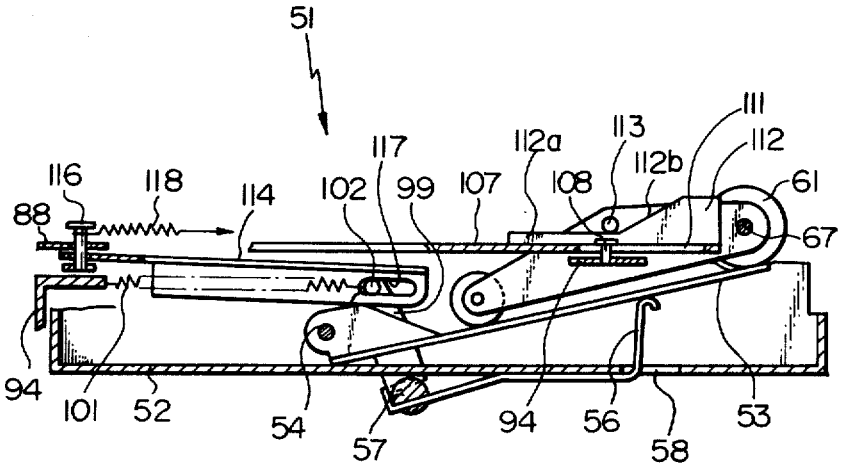
FIG. 12 is a side schematic view illustrating the present apparatus after a stack of sheets have been fed therefrom.

FIGS. 10 and 12 illustrate the case in which the last sheet 59 has been fed out of the cassette 52 and it is desired to detach the cassette 52 from the frame 84 to replenish the sheets 59. It will be seen from FIG. 10 that in this condition the end of the lever 88 is retained by the left end of a notch 119 formed in the side member 91 and is prevented in this manner from being swung in the direction of an arrow 121 by the spring 118. In accordance with an important feature of the present invention, a downward extension 122 of the lever 88 blocks the cassette 52 and prevents it from being detached from the frame 94. This is important since in the illustrated condition of FIGS. 10 and 12 the raising arm 56 and the skew preventing roller 68 are operatively disposed inside the cassette 52 and an attempt to detach or remove the cassette 52 would result in damage to these elements and possibly other elements of the apparatus 51.

The cassette 52 may be detached by pushing the lever 88 downwardly to free it from the notch 119 and then releasing the lever 88. The spring 118 will cause the lever 88 to pivot in the direction of the arrow 121 to the position of FIGS. 11 and 13 in which the lever 88 abuts against a vertical portion 123 of the frame 94. In this position, the extension 122 no longer blocks the path of the cassette 52 for detachment in the direction of the arrow 87.

In the position of FIGS. 10 and 12 the pin 113 is disposed above, but does not engage with, the low portion 112*a* of the cam 112 allowing the roller 68 to pivot freely about the shaft or pin 69. Also in the position of FIGS. 10 and 12 the pin 102 is disposed in an intermediate portion of the slot 117. Thus, the arm 56 and roller 68 are in a released condition and are free to operatively enter the cassette 52.

Figure 11:
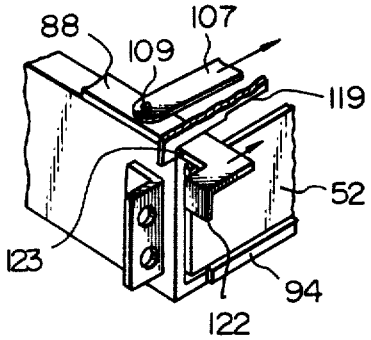
FIG. 11 is a fragmentary perspective view of a manual lever of the apparatus.

However, in the position of FIGS. 11 and 13, the link 107 and cam 112 are moved in the direction of an arrow 124 so that the pin 113 is engaged and raised by the high portion 112*b* of the cam 112. As shown in FIG. 13 the arm 71 and thereby the roller 68 are moved upwardly by the cam 112 and pin 113 so that these elements are clear of the cassette 52. Thus, the cassette 52 may be detached from the frame 94 without touching the raised arm 71 and roller 68.

As further illustrated in FIG. 13, movement of the lever 88 to the position of FIGS. 11 and 13 causes the link 114 to move in the direction of the arrow 103. The left end of the slot 117 engages the pin 102 and pivots the arm 99, shaft 57 and arm 56 in the direction of the arrow 104. In this position, the raising arm 56 is pivoted downwardly, clear of the cassette 52, as shown in FIG. 13. Thus, the cassette 52 may be detached from the frame 94 without interference from the arm 56.

In the manner described above, the lever 88 is moved from the position of FIG. 10 to the position of FIG. 11 and the cassette 52 is detached from the frame 94 in the direction of the arrow 87. It will be noted that the direction of detachment of the cassette 52 is perpendicular or transverse to the direction of sheet feed, since the feed roller 61 feeds the sheets 59 out of the cassette 52 in the direction of the arrow 103. After the cassette 52 is removed from the frame 84, a new stack of sheets 59 are placed in the cassette 52 with the edges aligned as illustrated in FIG. 6. Then, the cassette 52 is inserted back into the frame 84 to its original position and the lever 88 moved to the position of FIG. 10. The lever 88 must be raised slightly into the notch 119 so that it will be held thereby. The result of this operation is shown in FIG. 14. The left end of the slot 117 disengages from the pin 102 so that the arm 56 is released to be pivoted by the spring 101 into raising engagement with the bottom plate 53. The pin 113 is moved from the high portion 112*b* of the cam 112 to above the low portion 112*a* thereof so that the roller 68 is released to engage the top sheet 59. The apparatus 51 is now in condition for further use.

In summary, it will be seen that the present invention provides a sheet feed apparatus comprising means for preventing skew feed of sheets. The apparatus also allows a cassette to be inserted completely into the frame of a copying machine or the like from the front, thereby enabling considerable space savings. An arm for raising a stack of sheets into engagement with a feed roller and a skew preventing roller are moved clear of the cassette by a single lever to enable the cassette to be removed from the copying machine. The lever also functions to prevent damage to the apparatus which would result if an attempt was made to remove the cassette from the frame with the raising arm and skew preventing roller in their operative positions. The configuration of the apparatus comprising a single feed roller and corner separator enables sheets of any size to be fed from a single sheet cassette.

Various modifications will become possible for those skilled in the art after receiving the teachings of the present disclosure without departing from the scope thereof. For example, the cassette 52 may be supported in the frame 94 by bearings or rollers, although not illustrated.

What is claimed is:

1. A sheet feed apparatus including sheet support means for supporting a stack of sheets, a corner separator disposed at a corner of the support means, a corner of the stack being aligned with the corner of the support means and a feed roller disposed adjacent to the corner of the support means for feeding a top sheet of the stack of sheets in a direction such that a leading edge of the top sheet is separated from the stack by the corner separator, characterized by comprising:

skew preventing means disposed upstream of the feed roller in the direction of movement of the top sheet for engaging with and preventing skew of the top sheet; and a register roller disposed downstream of the skew preventing means in the direction of movement of the top sheet;

the skew preventing means comprising a skew preventing roller which is rotatable parallel to the feed roller;

the skew preventing roller being disposed between the feed roller and the corner separator in a direction perpendicular to the direction of movement of the top sheet;

the apparatus being adapted to feed sheets from stacks of sheets of a plurality of sizes, the apparatus further being constructed in such a manner that $LT \geqq LF$, where $Lmin > LR + LC + LF$ and $Lmin = LT + LR + LC$, LR being a distance between the feed roller and the skew preventing roller, Lmin being a minimum length of the stack of sheets in the direction of movement of the top sheet which the apparatus is constructed to accommodate, LT being a distance between the skew preventing roller and a trailing edge of a stack of sheets of said minimum length, LC being a distance between the feed roller and a leading edge of the stack of sheets and LF being a distance between the leading edge of the stack of sheets and the register roller.

2. An apparatus as in claim 1, in which the skew preventing roller is freely rotatable.

3. An apparatus as in claim 1, in which the skew preventing roller is urged into engagement with the top sheet by gravity.

4. An apparatus as in claim 3, in which the skew preventing means comprises a freely rotatable arm, the skew preventing roller being rotatably supported at an end of the arm.

5. An apparatus as in claim 1, further comprising presser means disposed between the feed roller and the skew preventing means for pressing the top sheet downwardly against the stack.

6. An apparatus as in claim 1, in which the sheet support means comprises a movable bottom plate, the apparatus further comprising raising means for raising the bottom plate so that the top sheet engages with the feed roller, the skew preventing roller being urged downwardly into engagement with the top sheet by gravity.

7. An apparatus as in claim 6, in which the sheet support means comprises a detachable cassette, said bottom plate being part of the cassette, the apparatus further comprising a manually movable member and linkage means connected between the movable member and the raising means and skew preventing roller, the movable member being movable between a first position in which the raising means and skew preventing roller are moved clear of the cassette by the linkage means and a second position in which the raising means and skew preventing roller are released by the linkage means.

8. An apparatus as in claim 7, in which the movable member is shaped to block detachment and insertion of the cassette when in the second position.

9. An apparatus as in claim 7, in which the linkage means comprises a cam connected to the movable member and a cam follower connected to the skew preventing roller.

10. An apparatus as in claim 7, in which the linkage means comprises a rotary arm, a pin fixed to an end of the rotary arm and a link connected to the movable member, the link being formed with an axial slot, the pin being fitted in the slot, an end of the slot abutting with the pin and moving the rotary arm to move the raising means clear of the cassette when the movable member is in the second position.

11. An apparatus as in claim 10, in which the raising means comprises a rotary shaft, the rotary arm being fixed to the rotary shaft, a raising arm fixed to the rotary shaft for raising engagement with the bottom plate and biasing means for urging the rotary shaft to rotate in a direction to cause the raising arm to raisingly engage with the bottom plate.

12. An apparatus as in claim 7, in which the cassette is detachingly movable in a direction perpendicular to the direction of feeding of the top sheet.

13. An apparatus as in claim 1, in which a distance between the feed roller and the skew preventing roller is selected so that all rotational moments exerted on the top sheet cancel.

* * * * *